United States Patent [19]

Dutertre

[11] Patent Number: 4,905,871

[45] Date of Patent: Mar. 6, 1990

[54] HANDLING DEVICE FOR AGRICULTURAL CHEMICALS AND THE LIKE

[76] Inventor: Donald F. Dutertre, Box 222, Dinsmore, Saskatchewan, Canada, S0L 0T0

[21] Appl. No.: 147,797

[22] Filed: Jan. 25, 1988

[30] Foreign Application Priority Data

Jun. 6, 1986 [CA] Canada ..... 511047

[51] Int. Cl.[4] ..... B67B 7/24

[52] U.S. Cl. ..... 222/83; 222/148; 222/108; 134/168 R; 137/571; 141/286

[58] Field of Search ..... 222/80, 81–83, 222/83.5, 87, 89, 148, 149, 151, 464, 108; 137/571, 572; 134/168 R, 167 R, 99, 100, 101, 171; 141/286, 65, 329, 330

[56] References Cited

U.S. PATENT DOCUMENTS

| | | | |
|---|---|---|---|
| 2,324,793 | 7/1943 | Minard | 141/286 X |
| 2,491,516 | 12/1949 | Piggot et al. | 222/82 X |
| 3,202,164 | 8/1965 | Thompson et al. | 137/101.11 |
| 3,240,392 | 3/1966 | Nicko | 222/82 |
| 3,348,734 | 10/1967 | Rice et al. | 222/1 |
| 3,512,676 | 5/1970 | Dawson et al. | 222/82 X |
| 3,764,041 | 10/1973 | Noll | 222/148 X |
| 3,776,468 | 12/1973 | Davenport | 239/310 |
| 3,866,636 | 2/1975 | Lasater | 141/59 |
| 3,916,924 | 11/1975 | McGowan | 134/95 |
| 3,993,221 | 11/1976 | Boynton et al. | 222/87 |
| 4,015,613 | 4/1977 | Papworth | 134/102 |
| 4,039,351 | 8/1977 | Butler | 134/102 |
| 4,078,699 | 3/1978 | Soto | 222/89 |
| 4,106,701 | 8/1978 | Siefken | 239/271 |
| 4,119,114 | 10/1978 | Bolton et al. | 134/166 R X |
| 4,144,901 | 3/1979 | Stevenson | 134/166 R X |
| 4,162,745 | 7/1979 | Anderson, Jr. | 134/168 R X |
| 4,250,911 | 2/1981 | Kratz | 137/268 |
| 4,278,132 | 7/1981 | Hostetter | 169/13 |
| 4,285,445 | 8/1981 | Vander Molen et al. | 222/49 |
| 4,344,469 | 8/1982 | Brown | 141/90 |
| 4,386,637 | 6/1983 | Buchanan et al. | 141/65 |
| 4,497,334 | 2/1985 | Wolf | 137/209 |
| 4,522,339 | 6/1985 | Costa | 239/272 |
| 4,582,223 | 4/1986 | Kobe | 222/82 |
| 4,749,010 | 6/1988 | Petell | 141/286 X |

*Primary Examiner*—Joseph J. Rolla
*Attorney, Agent, or Firm*—Irell & Manella

[57] ABSTRACT

When using containers of agricultural chemicals, such as herbicides, pesticides and the like, it is desirable to transfer the contents to the sprayer tank by pump means rather than physically lifting the container to the tank inlet and then pouring the contents manually into the tank. It is also essential to rinse out the container prior to disposing of same as most of the chemicals used are concentrated and can cause environmental damage if the majority of the contents are not removed prior to disposal. The present device allows the operator to transfer the chemical to the tank by means of a pump and then wash or rinse out the container with water which is then also transferred to the sprayer tank. A control valve portion connects to a concentric tube assembly which includes a container piercer on the lower end thereof. The valve means may be manipulated to pump the chemical from the container to the sprayer tank and to then pump water into the container and spray the interior thereof in order to thoroughly rinse same. The valves are then changed to pump the diluted chemicals into the sprayer tank. A flexible shroud surrounds the conduits and is spring-loaded to retain same in contact around the area of the container in which the piercer engages, in order to prevent concentrated chemicals from splashing the operator.

18 Claims, 2 Drawing Sheets

HANDLING DEVICE FOR AGRICULTURAL CHEMICALS AND THE LIKE

BACKGROUND OF THE INVENTION

This invention relates to new and useful improvements i handling devices particularly designed for use with agricultural chemicals and the like.

Agricultural chemicals, such as pesticides, fungicides, herbicides, and the like are usually highly concentrated and shipped in plastic or metal containers.

Normally, these are lifted onto the sprayer assembly and then manually poured into the sprayer tank. During this operation, there is danger of the operator being splashed by the chemicals, many of which are highly toxic and can be absorbed either orally or dermally, and considerable care must be taken in the transferring of the chemicals to the sprayer tank whereupon they are diluted with water to the correct strength, a process which often causes foaming, splashing and the like.

After the containers have been emptied, they should be thoroughly rinsed in order to remove the majority of the chemicals therefrom at which time they may be disposed of safely and without any danger of contamination occurring to the environment or to unauthorized personnel who may come into contact with such containers.

It is known that devices are on the market for rinsing such containers, but the present device shows considerable improvement over these because it is a self-contained device which, under control of the operator, may be connected to the pump of the sprayer in order to pump the liquid from the container to the sprayer tank without having to elevate and handle the container and then, by operating the valve mechanism thereof, may thoroughly wash the container with water and then pump the diluted chemical from the container into the sprayer tank.

In conjunction with the device is a container piercer which can either pierce the container directly whether it be plastic or metal or, alternatively, can pierce the container through the protective cardboard casing without removing the container thereby permitting the confining and control of chemical transfer from the container to the sprayer apparatus at all times.

PRIOR ART

Prior art known to applicant include the following U.S. Patents:

U.S. Pat. No. 4,278,132—July 14, 1981—shows a method of adding a non-pressurized source of liquid to a flowing stream of pressurized liquid and is usable with bulk shipping containers of varying sizes.

U.S. Pat. No. 4,250,911 —Feb. 17, 1981—illustrates the combination of a chemical feeder for liquid circulating systems with a vertically adjustable weir and a disposable container for chemicals.

U.S. Pat. No. 4,522,339—June 11, 1985—shows an irrigation fitting with an installation barb and associated barb installation tool.

U.S. Pat. No. 3,993,221—Nov. 23, 1976—shows a closed system chemical transfer apparatus with a punch member for piercing a hole through the top and bottom of the container.

U.S. Pat. No. 4,497,334—Feb. 5, 1985—teaches apparatus for cleaning a liquid delivery system consisting of a container having an open top with a control housing removably closing the top of the container.

U.S. Pat. No. 4,285,445—Aug. 25, 1981—discloses an apparatus for removing toxic liquid concentrates from the shipping and storage container and then rinsing the container when they are empty.

U.S. Pat. No. 3,776,468—Dec. 4, 1973—shows a spray mix applicator which includes a device for mixing and spraying a mixture of two liquids at a prescribed flow rate in a prescribed proportion to one another.

U.S. Pat. No. 3,202,164—Aug. 24, 1965—illustrates a liquid solution feeding device designed to maintain a pre-selected concentration of additive in the flow line by introducing the additive in quantities which are direct proportion to the rate of flow of liquid through the line.

In accordance with the invention, there is provided a chemical handling device for liquid agricultural chemicals and the like in containers, comprising in combination a dual conduit element, a container piercer on the lower end thereof and a selector valve assembly on the other end thereof being selectively and operably connected to said conduits, one of said conduits constituting a rinse liquid feed conduit, the other of said conduits constituting a chemical outlet conduit, said valve assembly including a rinse liquid inlet and a chemical outlet, said valve assembly selectively connecting said rinse liquid feed conduit to said inlet and said chemical outlet conduit to said outlet and a flexible protective shroud surrounding said conduits and slideable therealong to engage the portion of the associated container through which the said container piercer engages in order to contain liquid therein during the piercing action.

Another advantage of the invention is to provide a storage tube which encloses the concentric conduits of the container and seals the upper end of the storage tube thus preventing dust, dirt or the like from entering when the device is not in use.

A still further advantage of the invention is to provide a device of the character herewithin described in which rinsing ports are provided some of which are directed at right angles to the longitudinal axis of the concentric tubes and others which are directed outwardly and upwardly and which are particularly useful if the container is pierced from the lower side thereof as these outwardly and upwardly directed ports permit any sediment to be rinsed from the base of the container.

A still further advantage of the invention is is provide a device of the character herewithin described which includes a flexible boot or shroud which surrounds the conduits and is automatically engaged upon the surface of the container at the location through which the piercer is engaged thus preventing any splashing from occurring, particularly when the piercing action takes place. This also protects against chemical ejection due to container expansion which often occurs in relatively warn ambient temperatures.

Another advantage of the invention is to provide a device of the character herewithin described which is simple in construction, economically manufactured and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
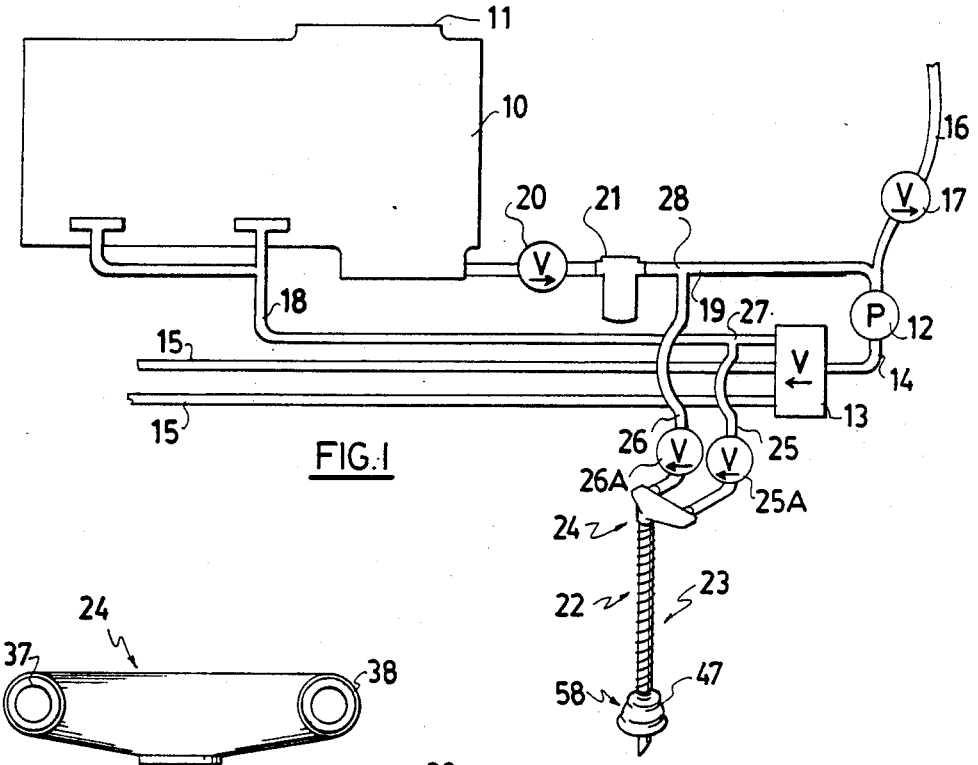
FIG. 1 is a schematic view of a sprayer assembly showing the device connected thereto.
Figure 2:
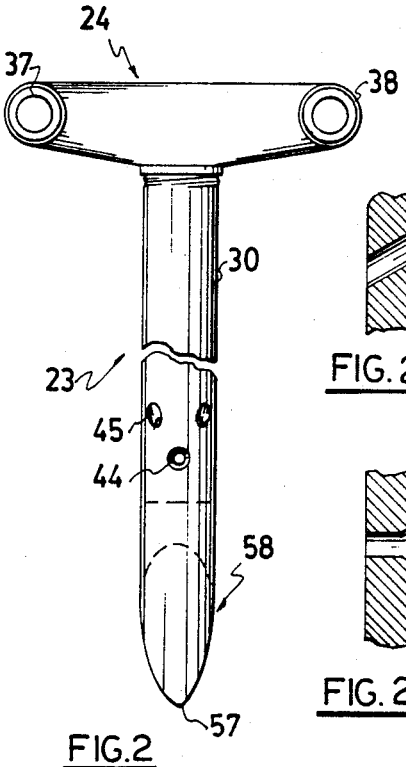
FIG. 2 is a front elevation of the device with the shroud removed for clarity.
Figure 2A:
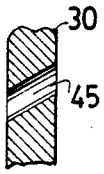
FIG. 2(A) is an enlarged fragmentary cross-sectional view of one of the upper rinse apertures.
Figure 2B:
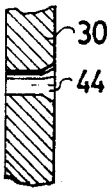
FIG. 2(B) is an enlarged fragmentary cross-sectional view of one of the lower rinse apertures.
Figure 3:
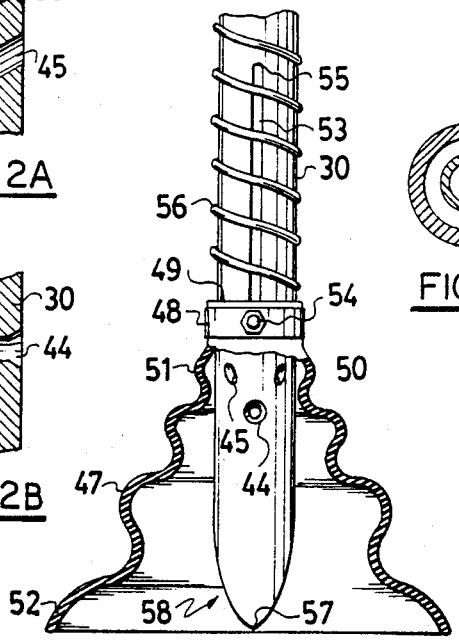
FIG. 3 is a fragmentary side elevation of the concentric conduits with the boot or shroud in position.

Proceeding therefore to describe the invention in detail, reference should first be made to the schematic view of the sprayer assembly shown in FIG. 1.

The sprayer tank is illustrated by reference character 10 with filler neck and cover shown at 11.

Reference character 12 illustrates the pump and a main control valve assembly 13, and a pump outlet conduit is shown at 14 connecting to the control valve 13. Lines 15 extend from the control valve and lead to the spray booms (not illustrated).

A water inlet 16 extends from the nurse tank truck (not illustrated) normally carrying water for filling the sprayer tank and this is also connected to the pump 12 by a quick-connect coupler (not illustrated) and includes a shutoff valve 17.

An agitation line 18 extends from the valve 13 to the interior of the sprayer tank and is used to agitate the chemicals so that no sediment builds up in the base of the tank and the solution within the tank maintains an overall equality of strength.

An outlet line 19 extends from the tank via shutoff valve 20 and filter 21, to the inlet side of the pump 12.

The device shown schematically is collectively designated 22 and includes a dual conduit element collectively designed 23 operatively connected to a selector valve assembly collectively designated 24. From this selector valve assembly, a pair of lines 25 and 26 extend controlled by manually operated valves 25A and 26A respectively.

Line 25 extends between the valve assembly 24 and the agitation line 18 and is connected by means of T-junction 27.

Line 26 is connected via T-junction 28, to the tank outlet line 19.

In normal operation of the sprayer device, valves 17, 25A and 26A are closed and valve 20 is open.

With the control valve 13 is always open so that agitation of the tank is continuous from line 18. The pump will draw chemical solution from tank, through filter 21, and through valve 13 into lines 15 (and also 18) which lead to the spray booms. The operative connection of the device 22 to the system will be explained later.

The invention shown in the remainder of the drawings includes the aforementioned selector valve assembly collectively designated 24 and the twin conduit component collectively designated 23.

The conduits include an outer rinse liquid feed conduit 30 and an inner concentric chemical outlet conduit 31.

The selector valve assembly 24 in this embodiment, is in the form of a casting providing a manifold 32 having a partition or divider 34 cast therein.

A water inlet nipple 35 is operatively connected to the portion 36 of the manifold on one side of the partition 34 and the chemical outlet nipple 37 is operatively connected to the other portion 38 of the manifold on the other side of the partition 34.

The conduit nipple 35 is provided with a manual control valve 25A and the conduit nipple 37 is provided with a manual control valve 26A and these nipples 35 and 37 are operatively connected to the aforementioned conduits 25 and 26 as shown in FIG. 1.

The outer conduit 30 is screw threadably engaged into a screw threaded aperture formed in the base of the manifold which connects to the portion 32 thereof. The inner conduit which is in concentric relationship with the outer conduit 30 is secured as by soldering or the like to an aperture 39 formed in to partition thus operatively connecting the inner conduit with the portion 38 of the manifold.

Figure 4A:
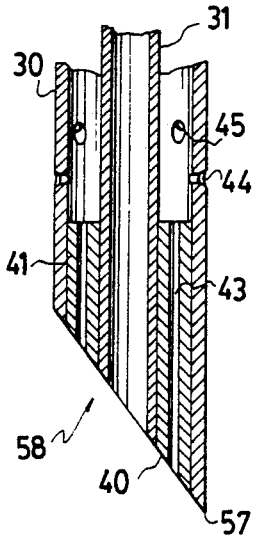
FIG. 4(A) is an enlarged fragmentary cross-sectional view of the lower end of the concentric conduits.
Figure 5:
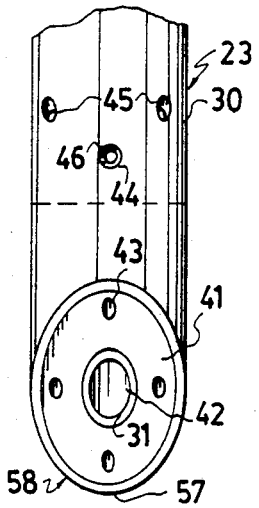
FIG. 5 is a fragmentary view of the lower end of the conduits reversed with respect to FIG. 3.

The lower ends of conduits 30 and 31 are cut on a diagonal angle as illustrated by reference character 40 (see FIG. 4A) thus forming a piercer which enables the conduits to be forced into the container containing the chemicals and the two conduits are sealed at the lower ends as by a filler material such as solder or a synthetic resin or a P.V.C. bushing. This filler material is indicated in FIGS. 4A and 5 by means of reference character 41. This means that the lower end 42 of the inner conduit 31 opens directly onto the lower end of the concentric conduits whereas the annular space 42 between the inner and outer conduits only connects externally by a series of ports as will hereinafter be described.

In FIG. 5, a plurality of longitudinally extending ports 43 extend through the filler material 41 parallel to the longitudinal axis of the conduits and communicate with the annular space 42 there between.

A second plurality of ports identified in the claims as a lower set, are indicated by reference character 44 and extend through the wall of the outer conduit 30 in a direction perpendicular to the longitudinal axis and are spaced equidistantly around the wall of pipe 30.

The upper set of apertures or drillings 45 also extend through the wall of the outer conduit 30 and are situated above the apertures 44. They are also staggered radially with relation to the lower set 44 and incline upwardly and outwardly through the wall at an angle of approximately 35 degrees from the vertical axis. The apertures 44 are preferably countersunk on the outer surface of the wall as indicated by reference character 46 and are of a sufficient size not to be plugged by any sediment which might be present in the agricultural chemicals being used.

A flexible shroud or boot 47 is secured around the outer conduit 30 above the sets of apertures 44 and 45 by means of a cylindrical clamp 48 securing the upper end of the boot to a ring sleeve 49 which slides on the outside of the outer conduit 30. The boot or shroud is formed from flexible rubber or synthetic plastic and is preferably corrugated as indicated by reference character 50 and increases in diameter from the upper end 51 towards the lower open end 52.

Figure 4:
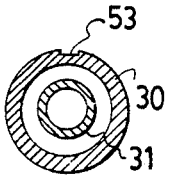
FIG. 4 is a cross-sectional view of the conduits per se.

A keyway or groove 53 is formed longitudinally along the wall of the outer conduit 30 to retain the boot or shroud on the conduits and limit the longitudinal movement thereof from the lowermost position shown in FIG. 4 to the uppermost position when pin 54, engaging through sleeve 49 and into groove 53, engages the upper end 55 of the groove. In this connection, it should be noted that two of the apertures 45 are situated on each side and below the groove to avoid any escape and splashing of the rinse water along the groove.

An elongated coil compression spring 56 surrounds the outer tube 30 and reacts between the underside of the manifold 24 and the upper side of the ring or sleeve 49 and normally urges the boot to the lowermost position shown in FIG. 4 under which circumstances the lowermost end 52 is below the lowermost end 57 of the piercer formed on the bottom end of the concentric tubes and indicated by reference character 58.

In operation, the device is engaged through the wall or closure of the associated container (not illustrated) by grasping the device by the selector valve or assembly and forcing the piercer downwardly through the wall of the tank and then lowering the assembly until the lower end 57 of the piercer registers against or is adjacent to the lower end of the container.

All during this action, the spring 56 maintains the flexible boot or shroud against the portion of the wall of the container through which the piercer is engaging thus preventing any splashing or spillage of the chemical during this action and protecting the operator from damage thereby.

Conduits 25 and 26 are operatively connected to conduits 18 and 19 respectively and the nipples 35 and 37 respectively.

If the line 16 and valve 17 are present (on relatively new sprayer assemblies), valves 20 and 25A are closed, valve 26A is opened and valve 17 is partially opened. Pump 12 draws chemical from the container through valve 26A, line 26 and into line 28 where it mixes with water from line 16 and is routed through control valve 13 into agitation line 18 and hence into the sprayer tank 10.

When all of the chemical has been evacuated from the container, valve 26A is closed and valve 25A is opened. Water is then being pumped from line 16 through valve 17 to line 19 and pump 12 and then to valve 13, into agitation line 18 with some of the water going to tank 10 and the remainder into line 25 through valve 25A and into the chemical container for rinsing. Water from the nurse tank flows into the annual space 42 or outer conduit 30. It is ejected through apertures 43, 44 and 45 under pressure thus completely washing the container and diluting any chemical residues therein with the position of the apertures insuring complete coverage of the interior of the container.

After rinsing is completed, the positions of the valves 25A and 26A are reversed to evacuate the rinse water and residual chemical through line 26, pump 12 and line 18 to tank 10.

When this evacuation of the container is completed, valves 25A and 26A are closed and valve 17 is fully opened in order to fill tank 10. When tank 10 is full, valve 17 is closed and valve 20 is open and line 16 may be disconnected from the nurse tank truck.

In older sprayers, without water inlet 16 and valve 17, water is fed to tank 10 by a hose inserted into inlet 11. Valve 20 is partly opened and water is mixed at 28 in line 19, with the concentrated chemical from the container through line 26, through valve 13 and into agitation line 18 and hence into tank 10, it being understood that pump 13 is actuated. Also with these older sprayers, rinsing is undertaken with the diluted chemical in water from tank 10.

When ready for spraying, valve 20 is open and valve 17 (if present) is closed. Both valves 25 and 26A are closed and the diluted chemical from tank 10 is drawn by pump 12 through line 19 to valve 13 with some solution passing through agitation line 18 to tank 10 for constant agitation to prevent sedimentation, and the remainder is pumped through lines 15 to the sprayer nozzles on the spray booms (not illustrated).

If the piercer had been engaged through the upper end of the container 10, apertures 44 and 45 would rinse the sides and upper wall of the tank and apertures 43, would wash any sediment from the base of the container.

Under some circumstances, it may be desirable to up end the container and engage the piercer through the base thereof. This method could be used if the upper walls or sides of the container are steeply sloped or if it is desired to destroy the usefulness of the container and prevent same from being used for other purposes.

Under these circumstances, apertures 43 would wash or rinse the upper end of the tank which is now facing downwardly apertures 44 would rinse the sides and apertures 45 would rinse or wash any sediment on the base of the container which is now at the upper end.

Figure 7:
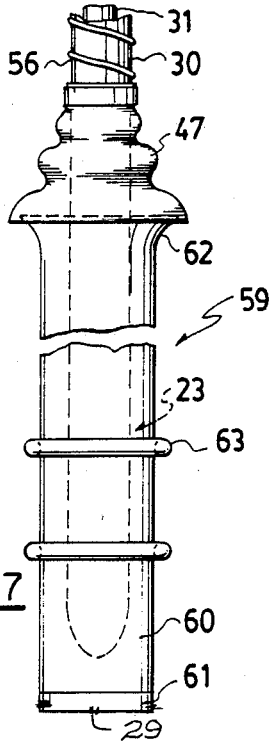
FIG. 7 is a front view of the storage holder with the device inserted therein, said device being shown in fragmentary form.
Figure 6:
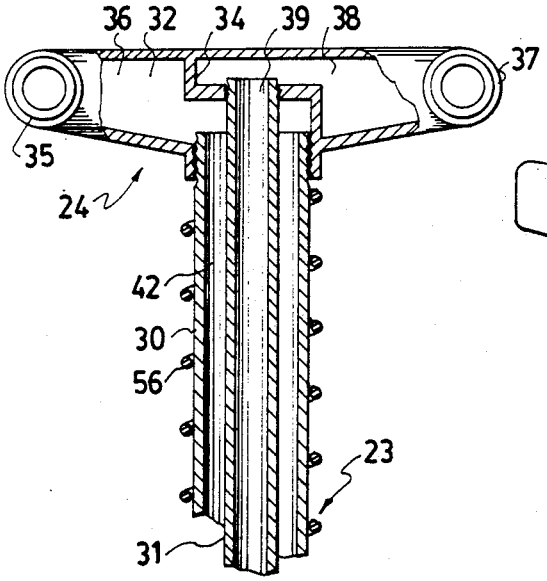
FIG. 6 is a fragmentary cross-sectional view of the valve manifold and the upper part of the concentric conduits.

When rinsing is completed, the device 22 may be stored in a storage tube collectively designated 59 and shown in FIG. 7. This a length of plastic piping 60 having a catch 61 closing the lower end thereof and supporting the device therein and having a bell 62 formed on the upper end thereof. The cap is provided with cross-slit 29 through same for drainage purposes.

U bolt clamps 63 may secure the device in a convenient location upon the sprayer in a vertical position ready for use when required.

The device is inserted into the tube as shown in FIG. 7 with the shroud or boot engaging over the upper belled end 62 and sealing the upper open end against the ingress of dust, dirt or the like. The weight of the assembly including the conduits 25 and 26 and the cast manifold or selector valve assembly 24 is such that it overcomes the extension of spring 56 so that the concentric conduits 23 extend substantially well into the storage tube 59 as shown in phantom in FIG. 8.

Figure 8:
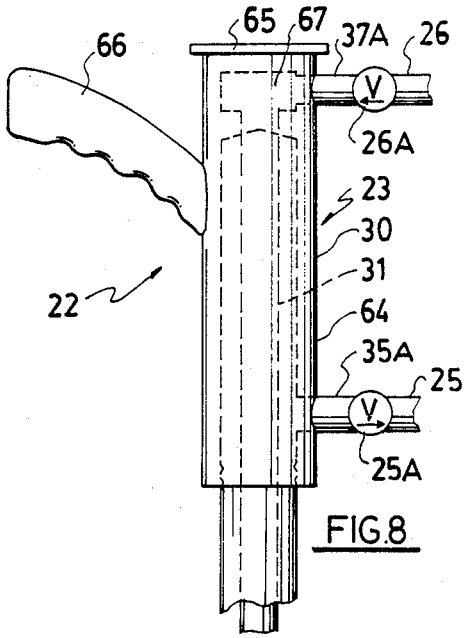
FIG. 8 is a front elevation of the preferred embodiment of the invention.

The preferred embodiment is shown in FIG. 8 with the upper end portion of the concentric tubes, namely, the selector valve assembly and manifold being constructed in a manner to avoid the relatively expensive casting forming the selector valve assembly 24 and manifold 32 of the previous embodiment.

A housing 64 is provided with a planar upper end 65 and an offstanding handle 66. The outer conduit 30 extends upwardly in the housing and may be drilled out or consist of a conduit extending up into the housing.

The upper end of this drilling or conduit is drilled out to sealably reduce the upper end of the inner concentric conduit 31 which extends into a transverse port 67 at the top of the housing with which a screw threaded nipple 37A is engaged communicating with a control valve 26A. This connects to line 26, and conveys chemical from the container as hereinbefore described.

A further transverse port 68 extends from outer conduit 30 adjacent the lower end of housing 64 to screw threaded nipple 35A and to valve 25A which in turn leads to line 25. This conveys water from the nurse tank as hereinbefore described for rinsing purposes.

The preferred embodiment operates the same way as the previous embodiment but is more economical to produce and easier to engage into the chemical container, it being understood that the lower end of the concentric conduits are similar to that of the previous embodiment.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A chemical handling device for liquid agricultural chemicals and the like in containers, comprising in combination a dual conduit element, a container piercer on the lower end thereof and a selector valve assembly on the other end thereof being selectively and operably connected to said conduits, one of said conduits constituting a rinse liquid feed conduit, the other of said conduits constituting a chemical outlet conduit, said valve assembly including a rinse liquid inlet and a chemical outlet, said valve assembly selectively connecting said rinse liquid feed conduit to said inlet and said chemical outlet conduit to said outlet and a flexible protective shroud surrounding said conduits and slidable therealong to engage the portion of the associated container through which the said container piercer engages in order to contain liquid therein during the piercing action, said flexible protective shroud including compression spring means surrounding said conduits to normally bias said shroud towards the piercer on the distal end of said conduits, an elongated groove formed on the outer wall of said outer conduit and means extending between said shroud and said groove for mounting said shroud for endwise movement along said outer conduit, said groove also acting as an air passageway to said container when said device is engaged therewith.

2. The device according to claim 1 which includes a storage tube for said device, said storage tube having an open upper end and a lower end cap supporting said device, said shroud engaging and sealing said open upper end when said device is engaged within said tube in storage position, and drain means in said lower end cap.

3. The device according to claim 1 in which said selector valve assembly includes a housing having a divider therein defining one portion on one side of said divider and a further portion on the other side thereof, said outer conduit extending upwardly into said one portion of said housing, the rinse liquid inlet connecting to said one portion and a control valve therefor, said inner conduit connecting to said further portion of said housing, a chemical outlet connector extending from said further portion extending from said further portion and a control valve therefor.

4. The device according to claim 1 in which said conduits are concentric one with the other.

5. The device according to claim 4 which includes a manifold within said valve assembly and a divider there between, said chemical outlet conduit and said chemical outlet being operatively connected to said manifold on one side of said divider, said rinse liquid feed conduit and said rinse liquid inlet being operatively connected to said manifold on the other side of said divider.

6. The device according to claim 4 in which said conduit terminates with a common diagonally angular lower end constituting said piercer, said outer conduit being sealed around said inner conduit at said lower ends thereof and ports through the wall of said outer conduit adjacent to and above said seal, said inner conduit constituting said chemical inlet conduit, said outer conduit constituting said rinse liquid feed conduit.

7. The device according to claim 6 which includes two sets of ports around the periphery of said outer conduit, a lower set extending through the wall approximately perpendicular to the longitudinal axis of said conduit and a second set situated above said first set and staggered radially therefrom and inclining upwardly and outwardly relative to the longitudinal axis of said conduit.

8. The device according to claim 7 which includes a storage tube forsaid device, said storage tube having an open upper end and a lower end cap supporting said device, said shroud engaging and sealing said open upper end when said device is engaged within said tube in storage position, and drain means in said lower end cap.

9. The device according to claim 6 which includes at least one port extending through said seal between the outer wall of said inner conduit and the inner wall of said outer conduit and substantially parallel to the longitudinal axis of said conduits.

10. The device according to claim 9 which includes at least one port extending through said seal between the outer wall of said inner conduit and the inner wall of sad outer conduit and substantially parallel to the longitudinal axis of said conduits.

11. A chemical handling device for liquid agricultural chemicals and the like in containers, comprising in combination a dual conduit element, a container piercer on the lower end thereof and a selector valve assembly on the other end thereof being selectively and operably connected to said conduits, one of said conduits constituting a rinse liquid feed conduit, the other of said conduits constituting a chemical outlet conduit, said valve assembly including a rinse liquid inlet and a chemical outlet, said valve assembly selectively connecting said rinse liquid feed conduit to said inlet and said chemical outlet conduit to said outlet and a flexible protective shroud surrounding said conduits and slideable therealong to engage the portion of the associated container through which the container piercer engages in order to contain liquid therein during the piercing action, in which said conduits are concentric one with the other, said conduits terminating with a common diagonally angular lower end constituting said piercer, said outer conduit being sealed around said inner conduit at said lower ends thereof and ports through the wall of said outer conduit adjacent to and above said seal, said inner conduit constituting said chemical outlet conduit, said outer conduit constituting said rinse liquid feed conduit and a storage tube for said device, said storage tube having an open upper end and a lower end cap supporting said device, said shroud engaging and sealing said open upper end when said device is engaged within said tube in storage position, and drain means is said lower end cap.

12. The device according to claim 11 which includes two sets of ports around the periphery of said outer conduit, a lower set extending through the wall approximately perpendicular to the longitudinal axis of said conduit and a second set situated above said first set and staggered radially therefrom and inclining upwardly and outwardly relative to the longitudinal axis of said conduit.

13. The device according to claim 11 which includes at least one port extending through said seal between the outer wall of said inner conduit and the inner wall of said outer conduit and substantially parallel to the longitudinal axis of said conduits.

14. The device according to claim 11 in which said selector valve assembly includes a housing having a divider therein defining one portion on one side of said divider and a further portion on the other side thereof, said outer conduit extending upwardly into said one portion of said housing, the rinse liquid inlet connecting to said one portion and a control valve therefor, said inner conduit connecting to said further portion of said housing, a chemical outlet connector extending from said further portion and a control valve therefor.

15. The device according to claim 11 in which said flexible protective shroud includes compression spring means surrounding said conduits to normally bias said shroud towards the piercer on the distal end of said conduits, an elongated groove formed on the outer wall of said outer conduit and means extending between said shroud and said groove for mounting said shroud for endwise movement along said outer conduit, said groove also acting as an air passageway to said container when said device is engaged therewith.

16. A chemical handling device for liquid agricultural chemicals and the like in containers, comprising in combination a dual conduit element, a container piercer on the lower end thereof and a selector valve assembly on the other end thereof being selectively and operably connected to said conduits, one of said conduits constituting a rinse liquid feed conduit, the other of said conduits constituting a chemical outlet conduit, said valve assembly including a rinse liquid inlet and a chemical outlet, said valve assembly selectively connecting said rinse liquid feed conduit to said inlet and said chemical outlet conduit to said outlet and a flexible protective shroud surrounding said conduits and slidable therealong to engage the portion of the associated container through which the said container piercer engages in order to contain liquid therein during the piercing action, and a storage tube for said device, said storage tube having an open upper end and a lower end cap supporting said device, said shroud engaging and sealing said open upper end when said device is engaged within said tube in storage position, and drain means in said lower end cap.

17. The device according to claim 16 in which said flexible protective shroud includes compression spring means surrounding said conduits to normally bias said shroud towards the piercer on the distal end of said conduits, an elongated groove formed on the outer wall of said outer conduit and means extending between said shroud and said groove for mounting said shroud for endwise movement along said outer conduit, said groove also acting as an air passageway to said container when said device is engaged therewith.

18. The device according to claim 17 in which said selector valve assembly includes a housing having a divider therein defining on- portion on one side of the divider and a further portion on the other side thereof, said outer conduit extending upwardly into said one portion of said housing, the rinse liquid inlet connecting to said one portion and control valve therefor, said inner conduit connecting to said further portion of said housing, a chemical outlet connector extending from said further portion and a control valve therefor.

* * * * *